United States Patent [19]

Fontenot

[11] Patent Number: 5,000,260

[45] Date of Patent: Mar. 19, 1991

[54] CASING SCRAPER

[75] Inventor: Martin J. Fontenot, Silsbee, Tex.

[73] Assignee: New World Down Hole Tools, Incorporated, Pasadena, Tex.

[21] Appl. No.: 461,976

[22] Filed: Jan. 8, 1990

[51] Int. Cl.[5] ..... E21B 37/02

[52] U.S. Cl. ..... 166/173; 15/104.16; 15/104.17; 166/174; 166/175

[58] Field of Search ..... 166/173, 174, 175, 176; 15/104.16, 104.17

[56] References Cited

U.S. PATENT DOCUMENTS

| | | | |
|---|---|---|---|
| 560,830 | 5/1896 | Balz | 15/104.17 X |
| 784,359 | 3/1905 | Stephenson | 15/104.16 |
| 1,165,441 | 12/1915 | Packingham | 15/104.16 |
| 1,666,000 | 4/1928 | Campbell | 166/174 |
| 2,141,508 | 12/1938 | Buckley et al. | 166/174 |
| 2,221,137 | 11/1940 | Hector | 166/174 |
| 2,464,390 | 3/1949 | Hammer | 166/173 |
| 4,189,000 | 2/1980 | Best | 166/173 |
| 4,706,748 | 11/1987 | Harris | 166/173 |

*Primary Examiner*—Hoang C. Dang
*Attorney, Agent, or Firm*—Keeling & Associates

[57] ABSTRACT

A casing scraper is provided for scraping foreign materials from the inside of pipe casing and other tubular members. The casing scraper is comprised of a central mandrel supporting a plurality of longitudinally and circumferentially extending scraper blades, the collective configuration of the scraper blades comprising a tube structure with the mandrel located at the longitudinal axis of the tube structure. Connecting links attach the mandrel to the plurality of scraper blades. Said connecting links are each pivotally attached to the mandrel and to the scraper blades. An adjustable spring is provided at the base of the mandrel and biased against the underside of the connecting links normally biasing said connecting links at a right angle to the axis of the mandrel, thereby normally positioning the scraper blades at the maximum distance from the mandrel allowed by the length of the connecting links. Upon assertion on the scraper blades of upward pressure or upon assertion on the scraper blades of downward pressure exceeding the spring force, the connecting links may extend at an angle other than ninety degrees from the mandrel, thereby allowing the scraper blades to retract inwardly toward the mandrel. The inward movement of the casing scraper blades is limited by the abutment of the longitudinal edges of the scraper blades. Interlocking extending sections and recesses are provided along the longitudinal edges of the scraper blades to provide continuity of the cutting surface.

11 Claims, 6 Drawing Sheets

CASING SCRAPER

BACKGROUND OF THE INVENTION

This invention relates to scrapers for cleaning the inside walls of tubular members, particularly to scrapers for cleaning the inside of oil well casings and gas well casings.

Modern oil and gas well completions employ the use of casing pipe to protect the integrity of the hole, as a conduit for various tubing and equipment used in exploiting the geographical formations, and to channel the desired oil, gas or other deposits to the surface.

The inside of the casing pipe is subject to the deposit of paraffin wax, grouting cements, rust, and scale. Burrs may occur on the inside of casing walls as a result of downhole operations such as perforation. These foreign materials and burrs act as an impediment in the free passage through the casing of equipment used to complete or work-over the well, and the unimpeded flow of the oil, gas or other deposits from the underground formations.

It has therefore been necessary in the petroleum industry to use scraping devices to scrape the interior of casing walls. To that end, a variety of casing scrapers have been used.

Prior devices used to scrape and clean the inside of well casing employed the rotational effects brought about from using a string of drilling pipe. These devices necessitated the use of rotary drilling equipment. Substantial time and effort is required to assemble the pipe string necessary to carry out a scraping operation with rotary apparatus. Piping scrapers attached to cables allow greater speed and consequently less expense.

Subsequent devices used to scrape and clean the inside of well casing did not require the use of rotational equipment, but depended upon a cutting or scraping action while being pulled up through the well casing. However, these devices suffered form other serious drawbacks. Chief among these drawbacks was the inability to compensate for immoveable restrictions inside the casing pipe while the scraping device was being raised during its pipe scraping mode. The scraper would pass through an obstruction in a downward direction but become lodged when the scraper was pulled upwards to scrape the casing wall. Being unable to compensate for immoveable restrictions, the scraping device would often have to be discarded in the well casing.

The various weights of casing material used in a particular well result in varying internal diameters to be cleaned by the casing scraper. Various attempts have been made to provide casing scraper devices capable of scraping various pipe diameters. Hammer U.S. Pat. No. 2,464,390 and Best U.S. Pat. No. 4,189,000 teach the use of spring means compressed between the mandrel and a plurality of cutting blades, the spring pushing the cutting blade toward the inside casing wall. The arrangement of the plurality of cutting blades and springs necessarily involved results in a complicated structure, each tool having a necessarily limited range of internal casing diameters which can be cleaned. Additionally, should the scraping device extend beyond the lower end of the pipe, the tools cannot be recovered due to the extension of the cutting blades beyond the diameter of the casing.

The prior scraping devices which depend on spring biasing have not historically been capable of withstanding the adverse loads encountered in operation. Due to the necessarily limited size of the spring devices, they are prone to failure.

Harris U.S. Pat. No. 4,706,748 teaches a pipe scraping device attached to a cable which allows the scraper blades to retract when the device is moved downward. However, the scraping device does not allow for retraction of the blades when the device is being raised during its pipe scraping mode. The scraping device may thus pass an immoveable obstruction while moving down the hole and be prevented from passing the obstruction while being pulled up the hole.

It is an object of this invention to provide an effective device for scraping foreign materials from the inside of pipe casing and other tubular materials.

It is a further object of this invention to provide a scraping device for use in oil and gas wells to be used in conjunction with a cable system.

It is a further object of this invention to provide a scraping device for use in oil and gas wells casing capable of compensating for immoveable restrictions inside the casing pipe.

It is a further object of this invention to provide a scraping device for oil and gas wells capable of effectively scraping the inside of pipe casing of varying diameters.

It is a further object of this invention to provide a scraping device for use in oil and gas wells having scraping blades which may be retracted during upward movement of the scraping device to allow movement past immoveable restrictions.

SUMMARY OF THE INVENTION

The foregoing and other objects of this invention are accomplished by providing a casing scraper for scraping foreign materials from the inside of pipe casing and other tubular members. The casing scraper is comprised of a central mandrel supporting a plurality of longitudinally and circumferentially extending scraper blades, the collective configuration of the scraper blades comprising a tube with the mandrel located at the longitudinal axis of the tube structure. Connecting means attach the mandrel to the plurality of scraper blades. Said connecting means are each pivotally attached to the mandrel and to the scraper blades. Adjustable spring means are provided at the base of the mandrel and biased against the underside of the connecting means normally biasing said connecting means at a right angle to the axis of the mandrel, thereby normally positioning the scraper blades at the maximum distance from the mandrel allowed by the length of the connecting means. Upon assertion on the scraper blades of upward pressure or upon assertion on the scraper blades of downward pressure exceeding the spring force, the connecting means may extend at an angle other than ninety degrees from the mandrel, thereby allowing the scraper blades to retract inwardly toward the mandrel. The inward movement of the casing scraper blades is limited by the abutment of the longitudinal edges of the scraper blades. Interlocking extending sections and recesses are provided along the longitudinal edges of the scraper blades to provide continuity of the cutting surface when the blades are in their open position.

DESCRIPTION OF PREFERRED EMBODIMENTS

Figure 1:
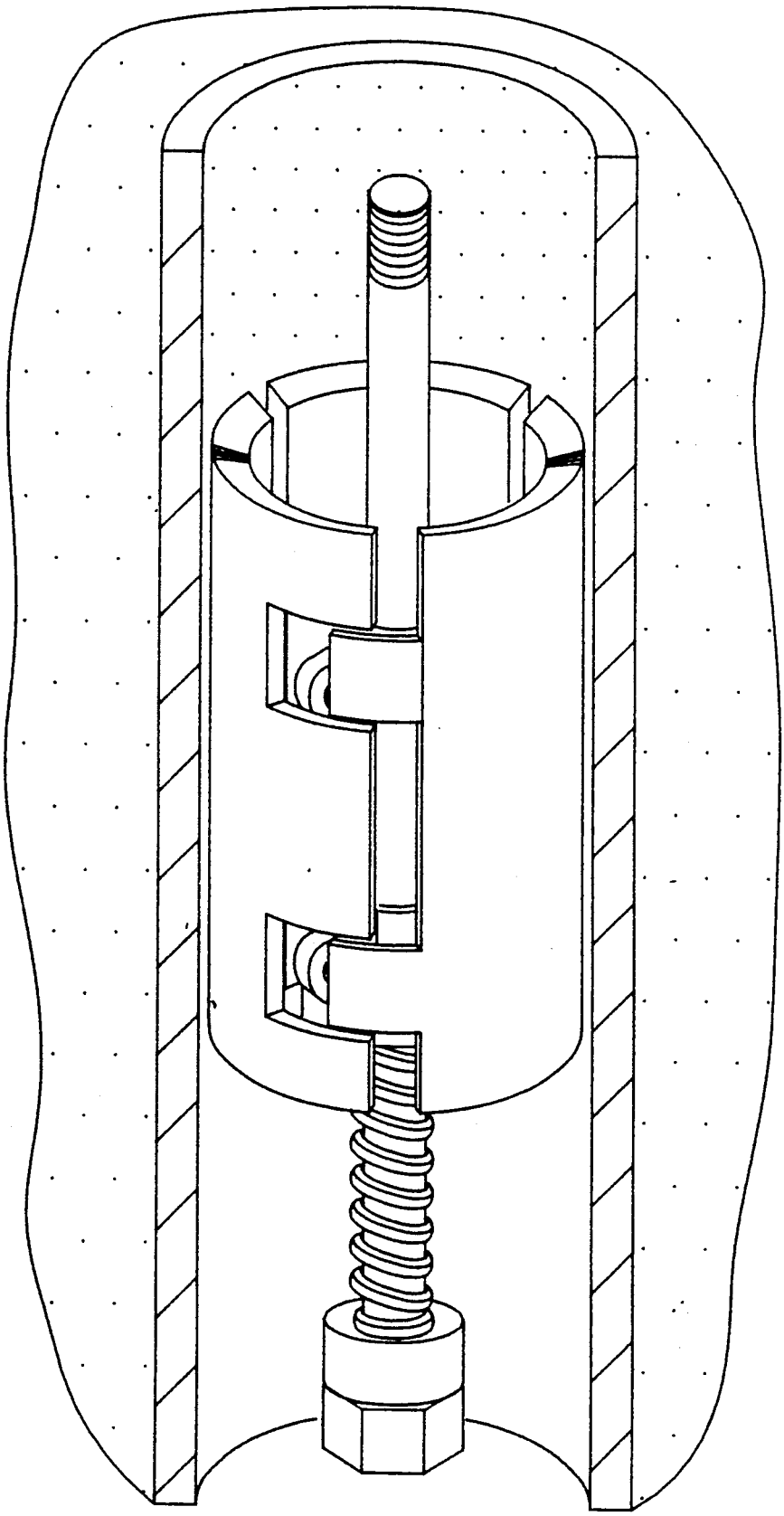
FIG. 1 is a perspective view of the casing scraper of the present invention.

Referring first to FIG. 1, a perspective view of the casing scraper 10 of the present invention is shown located within well casing 50. Mandrel 11 is encompassed by, and extends axially through, a hollow cylindrical structure defined by scraper blade 15, scraper blade 16 and scraper blade 17. Scraper blade 15, scraper blade 16, and scraper blade 17 are each connected to mandrel 11 by means not shown in FIG. 1. Mandrel 11 further extends through the axis of hollow cylindrical spring support member 12. Nut 46 engages mandrel 11 restraining cylinder spring support member 12 on mandrel 11. Cylindrical support member 12 supports spring 13, which spring 13 surrounds and extends upward parallel to the axis of mandrel 11.

Still referring to FIG. 1, rectangular opening 18 and rectangular opening 19 are provided in longitudinal edge 51 of scraper blade 15. Rectangular extension 20 and rectangular extension 21 are provided on the longitudinal edge 52 of scraper blade 17 such that extension 20 extends into opening 18 and extension 21 extends into opening 19 providing, in effect, interlocking surfaces along longitudinal edge 51 of scraper blade 15 and longitudinal edge 52 of scraper blade 17. Scraper blade 15 is likewise provided with extensions (not shown) and scraper blade 16 is likewise provided with openings (not shown) along their contiguous longitudinal edges allowing for interlocking of longitudinal edges of scraper blade 15 with edges of scraper blade 16 in a manner like the interlocking of scraper blade 17 with scraper blade 15 as described. Likewise, scraper blade 16 is provided with extensions (not shown) and scraper blade 17 is provided with openings (not shown) along their contiguous longitudinal edges providing interlocking of scraper blade 16 with scraper blade 17 in a manner like the interlocking of scraper blade 17 with scraper blade 15. The various interlocking extensions like extensions 20 and 21 and openings like openings 18 and 19 provided in blades 15, 16 and 17 along their longitudinal edges function to provide a continuous cutting surface when the casing scraper 10 is pulled upward and provide structural stability of the hollow cylinder defined by scraper blades 15, 16 and 17.

It may be seen from FIG. 1 that scraper blade 15, scraper blade 16 and scraper blade 17 comprise in composite form a hollow cylinder.

Still referring to FIG. 1, scraper blade 15 is provided with a beveled edge 22 at its upper end, scraper blade 16 is provided with upper beveled edge 23, and scraper blade 17 is provided with upper beveled edge 24. Edge 22, edge 23, and edge 24 are beveled such that the outer edge of each comprises an acute angle with the respective outside exterior surface of scraper blade 15, scraper blade 16, and scraper blade 17. Beveled edge 22, beveled edge 23, and beveled edge 24 comprise cutting edges of the casing scraper 10.

It may be further seen with reference to FIG. 1 that extension 20 of blade 17, and to a lesser extent extension 21 of blade 17 provide a cutting edge along the upper edge of the said extensions 20 and 21. In like manner, extensions (not shown in FIG. 1) provided on scraper blade 15 and extensions (not shown in FIG. 1) on scraper blade 16 additionally provide cutting edges along the upper edge of each of said extensions.

Still referring to FIG. 1, mandrel 11 is provided with an upper threaded end 25 for connection to a cable system (not shown) and power source (not shown). The cable system and power source provide the means of moving the casing scraper 10 along the axis of the well casing 50.

Figures 2, 2A:
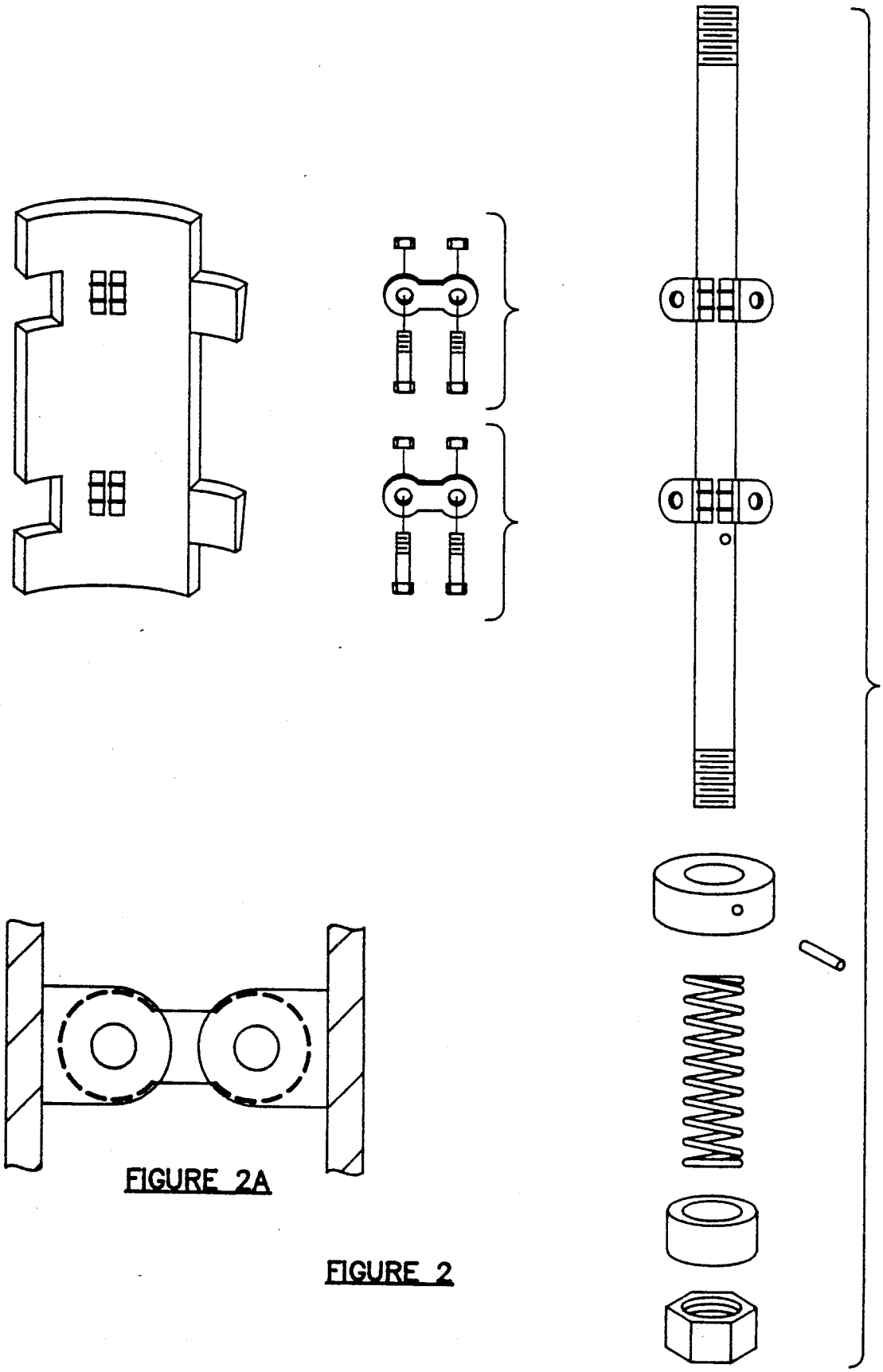
FIG. 2 is a view of the mandrel, spring and one of the scraper blades of the casing scraper.
FIG. 2A is a detailed view of a pivot link and anchor.
Figure 3:
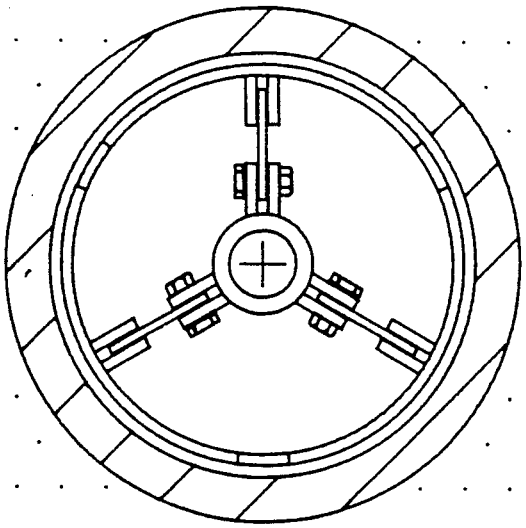
FIG. 3 is a plan view of the casing scraper.

Referring now to FIG. 2, the means of connecting scraper blade 15 to mandrel 11 is depicted. Pivot anchor 28, pivot anchor 29, pivot anchor 30, and pivot anchor 31 are provided on the interior surface of blade 15 extending in the direction of mandrel 11. Referring to FIG. 2A, pivot anchor 28 is provided with an opening 32. Pivot anchor 29, pivot anchor 30, and pivot anchor 31 each comprise a structure equivalent to pivot anchor 28, and each is provided with an opening equivalent to opening 32. Pivot anchor 28 and pivot anchor 29 are rigidly connected to the interior surface of blade 15 extending in the direction of mandrel 11. Pivot anchors 28 and 29 are parallel to each other such that opening 32 and its corresponding opening (not shown) in extension 29 have coincidental axes. Pivot anchor 30 and pivot anchor 31 each comprise structures equivalent to pivot anchor 28 and are likewise located on the interior surface of blade 15 extending toward mandrel 11. Pivot anchors 30 and 31 likewise are provided with openings having coincidental axes.

Pivot anchor 33 and pivot anchor 34 comprise an equivalent structure to pivot anchor 28 and pivot anchor 29. Pivot anchor 33 and pivot anchor 34 have openings with coincident axes and are each rigidly connected to mandrel 11 extending toward scraper blade 15. Opening 37 provided in pivot anchor 34 is depicted in FIG. 2A. Pivot anchor 35 and pivot anchor 36 are structurally equivalent to pivot anchors 33 and 34. Pivot anchors 35 and 36 are also rigidly connected to mandrel 11 extending toward scraper blade 15.

Still referring to FIG. 2, connecting link 26 is provided to link pivot anchor pair 28 and 29 with pivot anchor pair 33 and 34. Connecting link 26 is provided with openings 38 and 39. Referring to FIG. 2A, it may be seen that connecting link 26 is arranged in the space between pivot anchor 28 and pivot anchor 29 at one end and between pivot anchor 33 and pivot anchor 34 at the other end, thereby connecting scraper blade 15 with mandrel 11. Opening 32 provided in pivot anchor 28, the like opening (not shown) provided in pivot anchor 29 and opening 38 provided in connecting link 26 are so sized and spaced as to be aligned upon insertion of connecting link 26 into the space between pivot anchor 28 and pivot anchor 29. Likewise, opening 37 of pivot anchor 34, the corresponding opening (not shown) of pivot anchor 33 and the opening 39 provided in connecting link 26 are sized and spaced to provide a continuous opening when connecting link 26 is inserted in the space between pivot anchor 33 and pivot anchor 34. Upon alignment of the openings as previously described, pin 40 may be inserted through opening 32, opening 38 and the opening (not shown) provided in pivot anchor 29. Likewise, pin 41 may be inserted through opening 37, through opening 39, and the opening (not shown) provided in pivot anchor extension 33. Pins 40 and 41 are so sized as to fit snugly within the said openings. Pins 40 and 41 are further provided with threaded ends and nuts 53 and 54 so that pins 40 and 41 are securely held within the said openings.

Still referring to FIG. 2 and FIG. 2A, it may be seen that the structure of connecting link 26, pivot anchor pair 28 and 29, and pivot anchor pair 33 and 34 allow the movement of scraper blade 15 with reference to mandrel 11 about the axis defined by pin 40 and about the axis defined by pin 41. Scraper blade 15 extends to its greatest distance from mandrel 11 when connecting pin 26 is extended perpendicular to scraper blade 15 and the axis of mandrel 11. Upon rotation about either axis 40 or axis 41, scraper blade 15 is necessarily drawn toward mandrel 11. It may be further seen that the scraper blade, absent other restrictions, is free to rotate about the axes defined by pins 40 and 41 in an upward or downward direction. The extent of rotation of scraper blade 15 about axes defined by pins 40 and 41 is limited by the abutment of the longitudinal edges of scraper blade 15 with the corresponding longitudinal edges of scraper blades 16 and 17.

Connecting link 27 likewise connects scraper blade 15 with mandrel 11 at the location of pivot anchor pair 30 and 31 and pivot anchor pair 35 and 36. Connecting link 27 comprises a structure equivalent to connecting link 26. Scraper blade 15 may move in relation to mandrel 11 about the axis defined by pin 55 and about the axis defined by pin 56. With connecting link 26 and connecting link 27 each attached to their respective pivot anchor pairs on scraper blade 15 and mandrel 11, scraper blade 15 is maintained parallel to mandrel 11, regardless of the angle of inclination of connecting links 26 and 27.

Still referring to FIG. 2, spring 13 is shown disconnected from mandrel 11. Hollow, cylindrical, connecting link support member 14 is so formed and structured that core opening 43 of support member 14 is slightly larger than the outside diameter of mandrel 11 and support member 14 is slideably moveable in relation to mandrel 11. Spring 13 is so structured that a cylindrical opening 44 is defined by the inner surfaces of the coils of spring 13 which cylindrical opening is slightly larger than the outer diameter of mandrel 11. Likewise, core opening 45 provided in cylinder spring support 12 is slightly larger than the outside diameter of mandrel 11 and is slideably moveable on mandrel 11. Threaded section 42 is provided at the lower end of mandrel 11. Threaded nut 46 is provided with interior threading 47. The location of spring support member 12 on mandrel 11 may be adjusted by adjusting the location of threaded nut 46 on mandrel 11, thereby adjusting the compression of spring 13.

Figure 4:
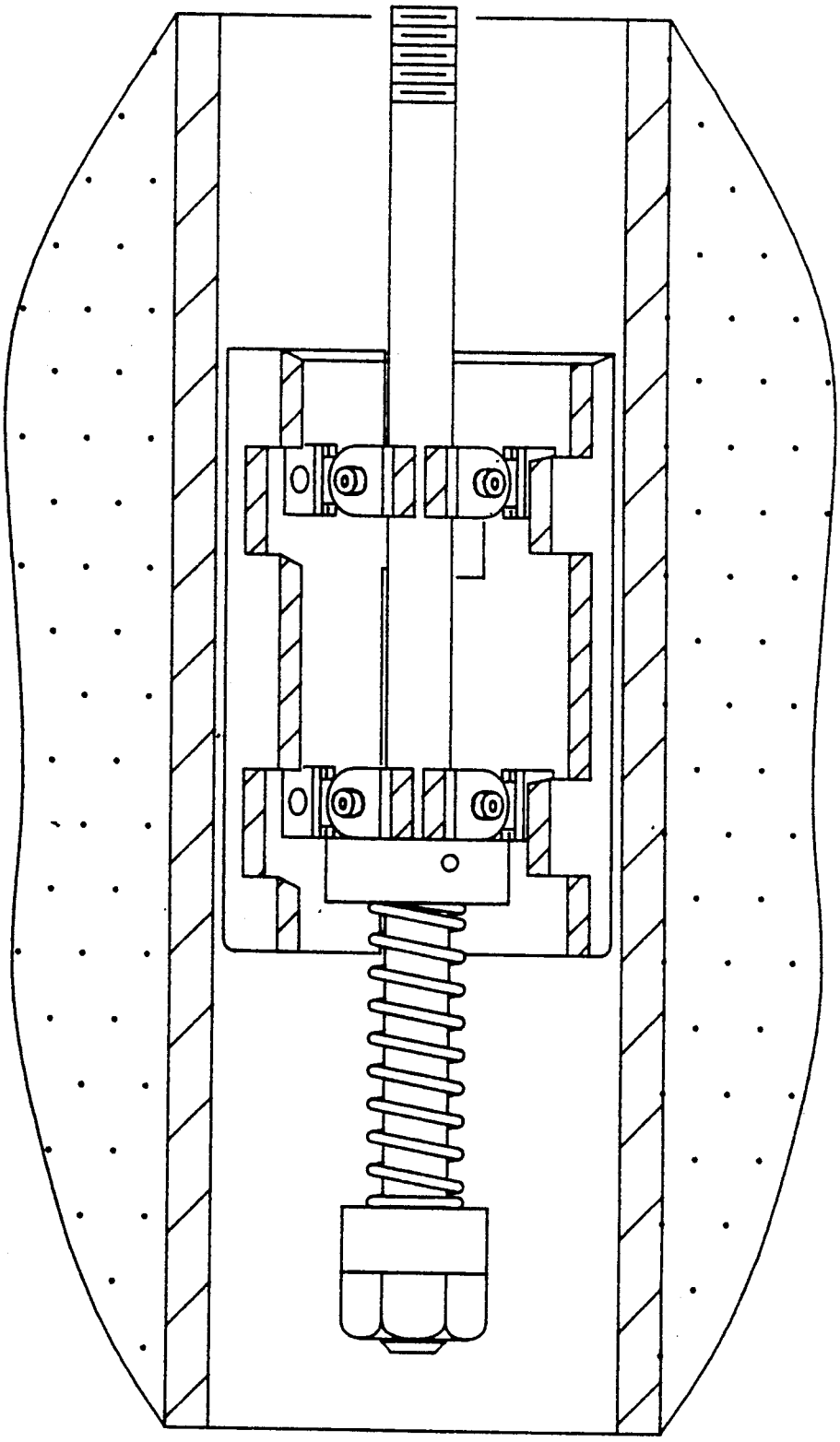
FIG. 4 is a perspective partial cut-away view of the casing scraper in its normal operating mode.

Now referring to the cut-away view of the assembled casing scraper 10 depicted in FIG. 4, mandrel 11 extends through opening 43 (not shown) of support member 14, through cylindrical opening 44 and through opening 45 (not shown) of support member 12, with threaded nut 46 securely attached to threaded end 42 of mandrel 11. The upper surface 48 of member 14 engages the lower edge 49 of connecting link 26 as the downward force of the weight of scraper blade 15 biases connecting link 26 against upper surface 48. Spring 13 is so sized in relation to the space between member 14 and support member 12 as to exert a force countervailing the weight of scraper blade 15 so as to normally maintain connecting link 26 in an orientation perpendicular, or nearly perpendicular, to mandrel 11 and the inner surface of scraper blade 15.

Referring to FIGS. 1, 2, 2A, 3 and 4, it may be seen that scraper blade 16 and scraper blade 17 are each connected to mandrel 11 by connecting links, scraper blade pivot anchors, mandrel pivot anchors and pins in a manner equivalent to the connection of scraper blade 15 to mandrel 11. Still referring to the said drawings, spring 13 likewise exerts an upward force through support members against the underside of the lower connecting links on scraper blades 16 and 17. The compression of spring 13 between spring support member 12 and member 14 may be adjusted so that the normal balance of forces between spring 13 and the weight of blades 15, 16, and 17 allow connecting link 26 and like connecting links to be normally perpendicular to the plane of blades 15, 16, and 17 and to the axis of mandrel 11.

Referring to FIG. 1, interlocking extension 20 and opening 18 are so constructed that extension 20 fits snugly within opening 18 when scraper blades 17 and 15 are in a retracted mode. Likewise, interlocking extension 21 and opening 19 are so constructed that extension 21 fits snugly within opening 19 when scraper blade 17 and scraper blade 15 are in a retracted position. Likewise, interlocking extensions and openings are provided in the contiguous longitudinal walls of scraper blade 15, scraper blade 16 and scraper blade 17, which extensions and openings fit snugly along the longitudinal edges of the said scraper blades when the scraper blades are in a retracted position.

Referring again to FIG. 2, an opening 60 is provided in member 14, which opening 60 extends through the wall of member 14. An opening 61 of equivalent diameter is provided in mandrel 11 at a location on mandrel 11 below pivot anchors 33 and 34. Opening 60 is so arranged on member 14 and opening 61 is so arranged on mandrel 11 that the openings coincide when the scraper blades 15, 16 and 17 are in an annularly expanded position with the connecting links perpendicular, or nearly perpendicular, to the axis of mandrel 11. Shear pin 59 is snugly fitted within opening 60, extending through opening 60 into opening 61. The material of construction of shear pin 59 is rigid but less strong than the material from which cylinder 14 and the material from which mandrel 11 are constructed. The strength of material used for shear pin 59 is determined such that shear pin 59 will shear when member 14 is moved in relation to mandrel 11. As member 14 would not be moved as a result of upward movement of scraper blades 15, 16 and 17, the shearing of shear pin 59 normally indicates that material with resistive force sufficient to overcome the countervailing force of spring 13 has been encountered by the scraper blades 15, 16 and 17 when the casing scraper is pulled upward in the scraping mode.

OPERATION OF THE INVENTION

Figure 5:
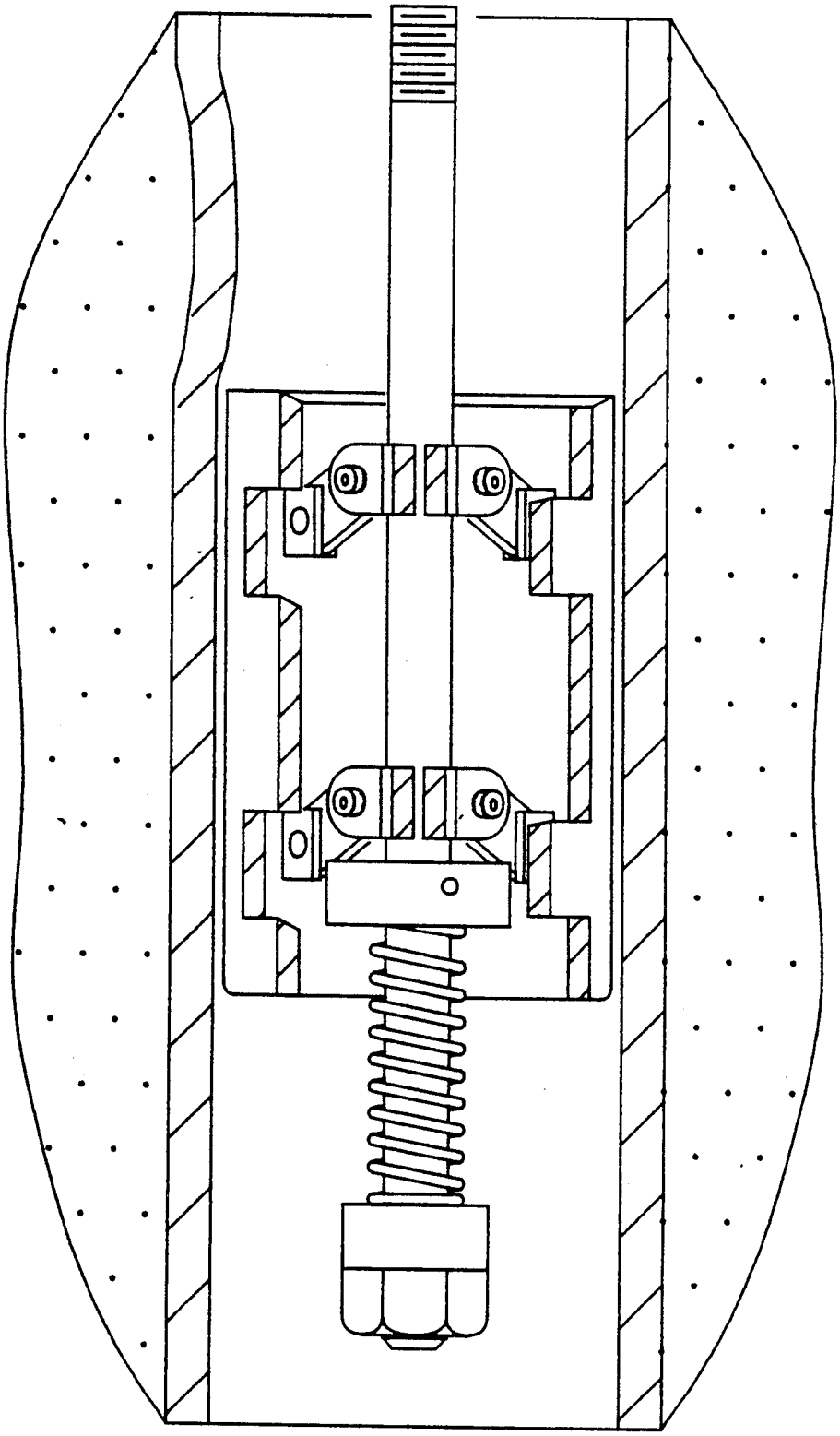
FIG. 5 is a perspective partial cut-away view of the casing scraper with the spring means compressed.
Figure 6:
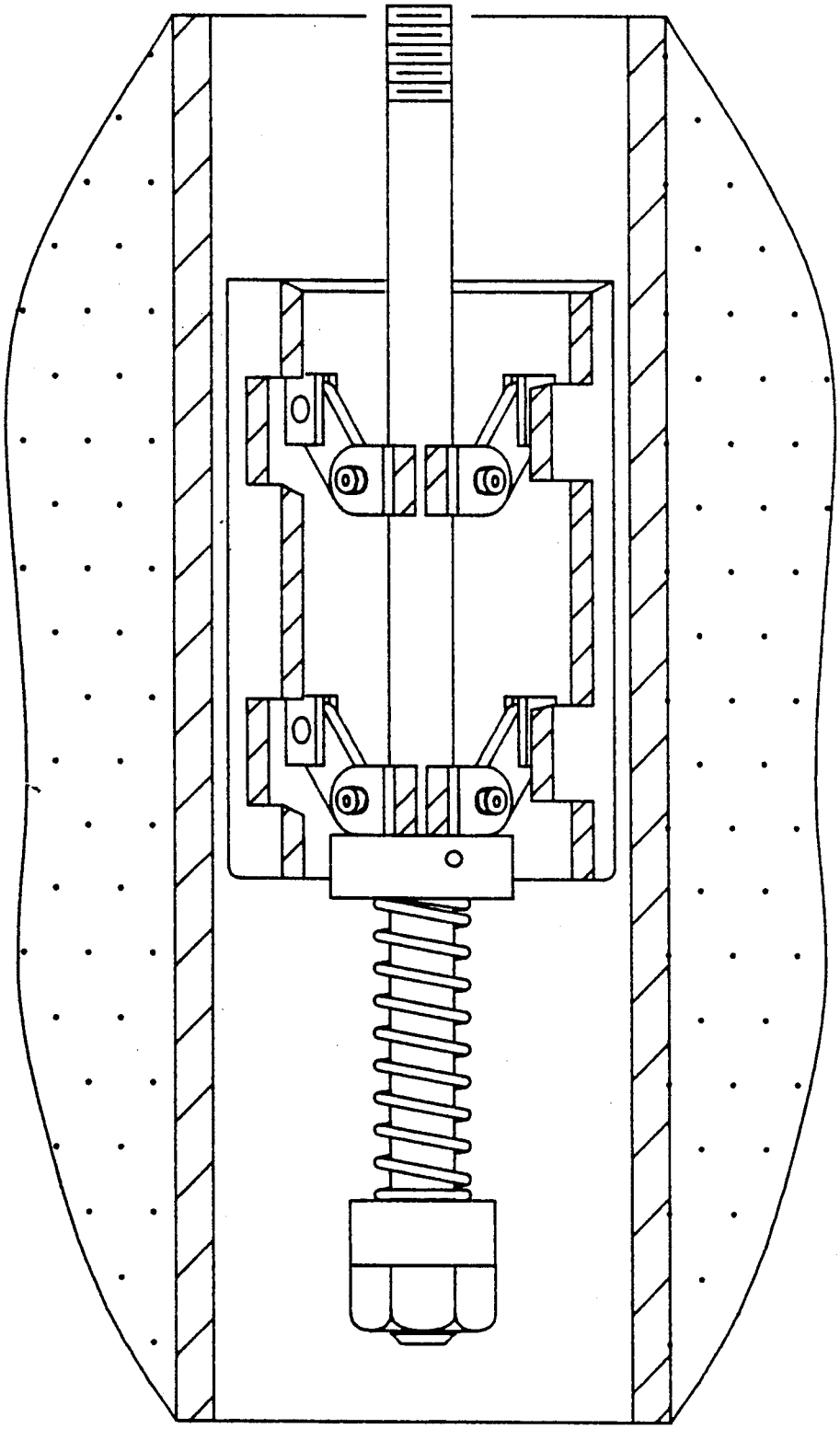
FIG. 6 is a perspective partial cut-away view of the casing scraper with the blades retracted.
Figure 1:
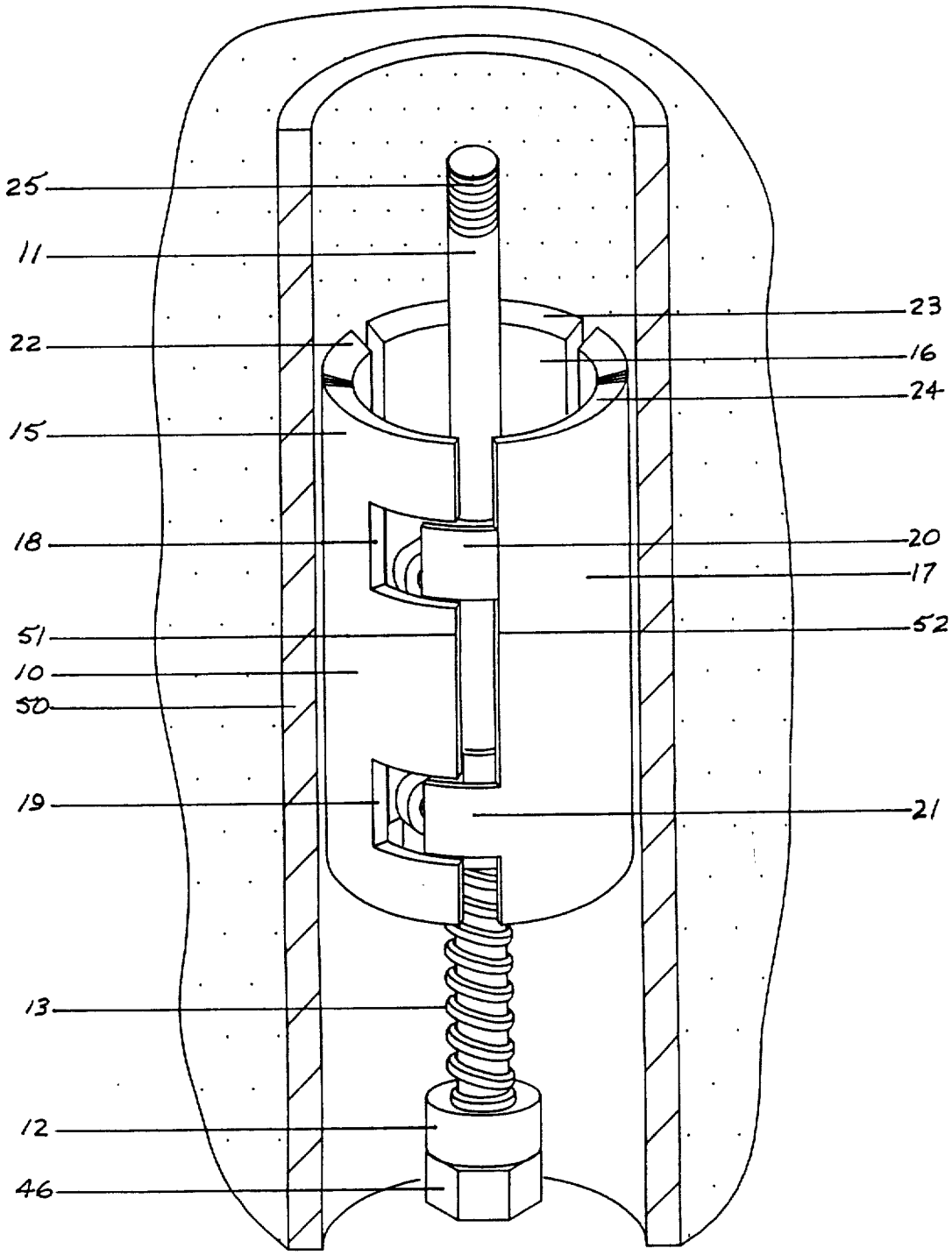
Figures 2, 2A:
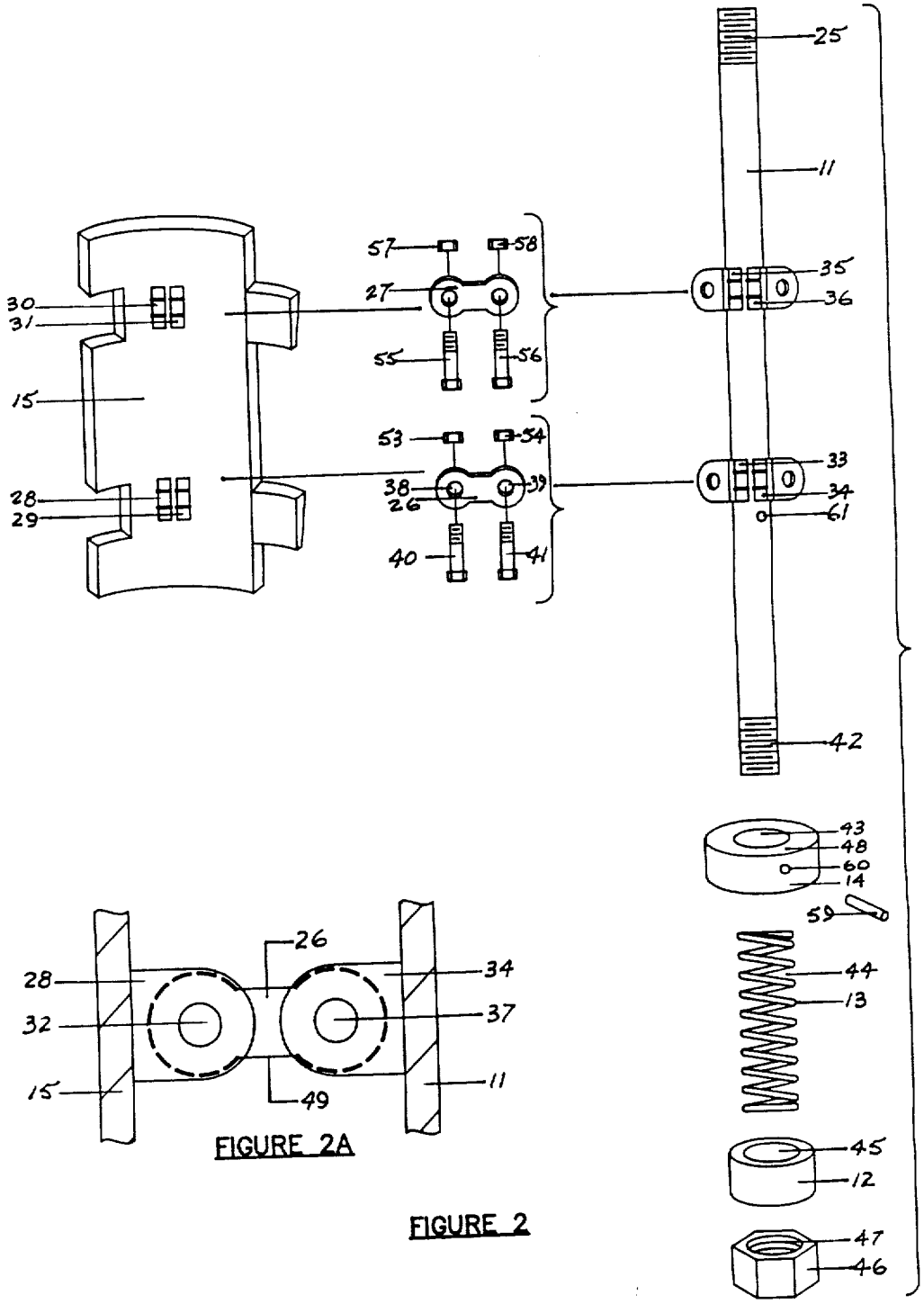
Figure 3:
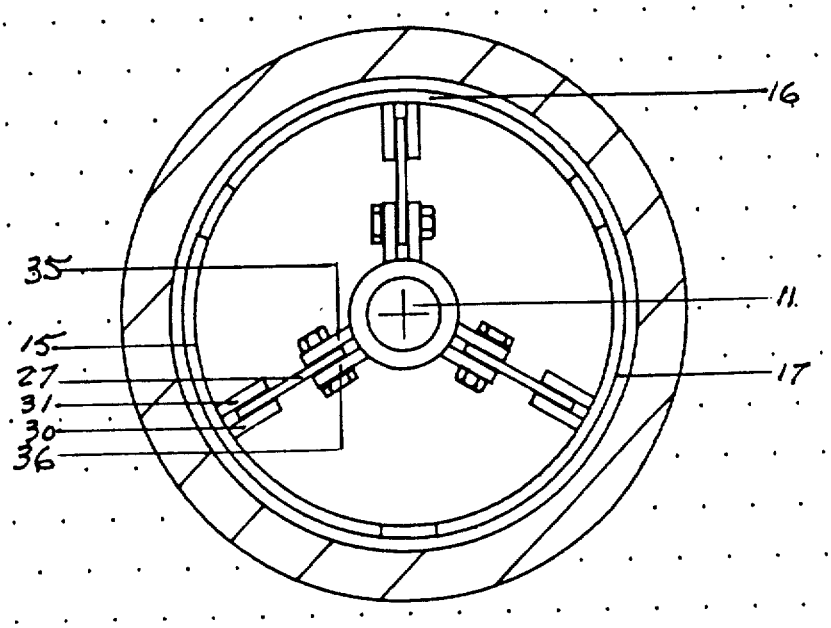
Figure 4:
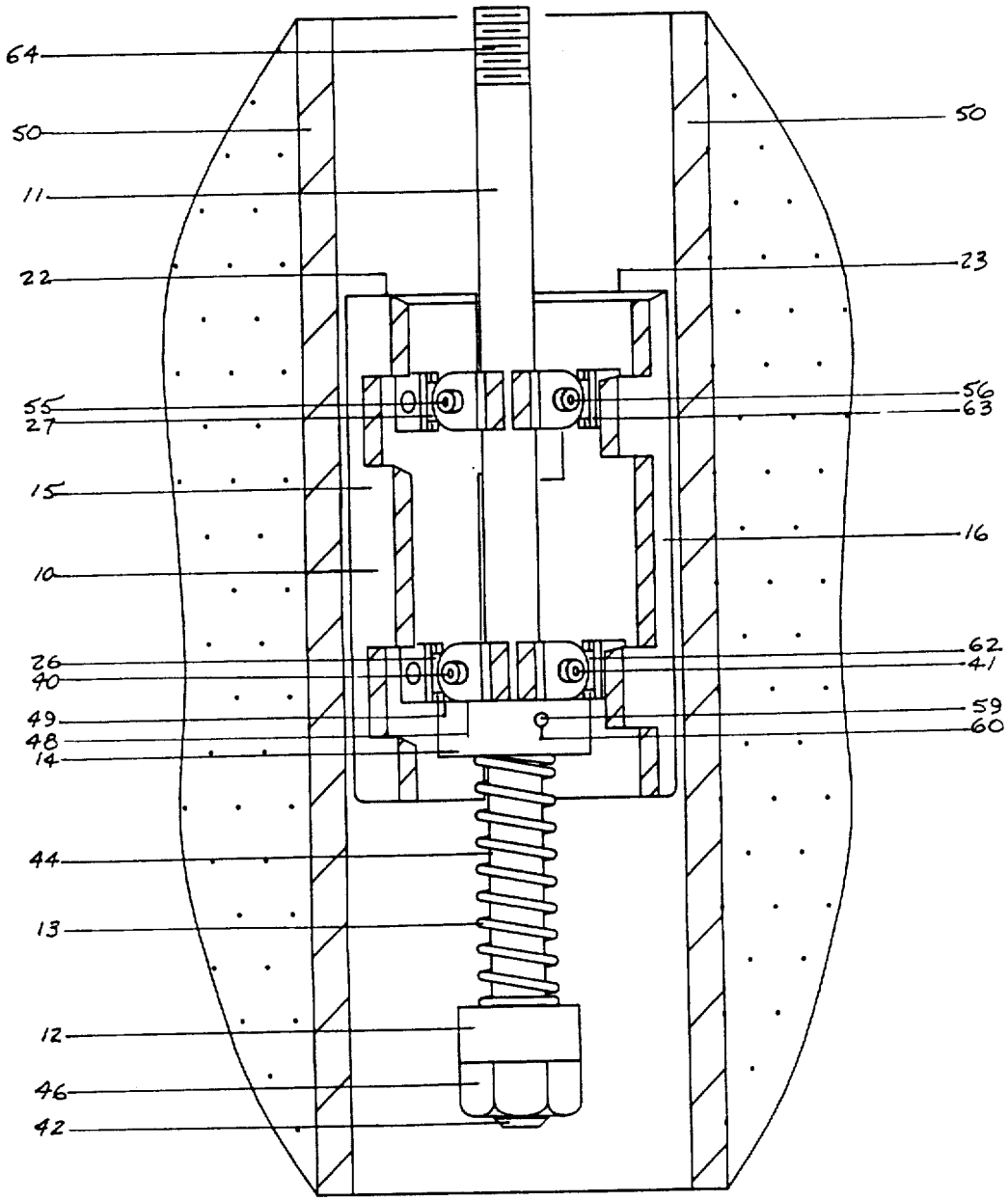
Figure 5:
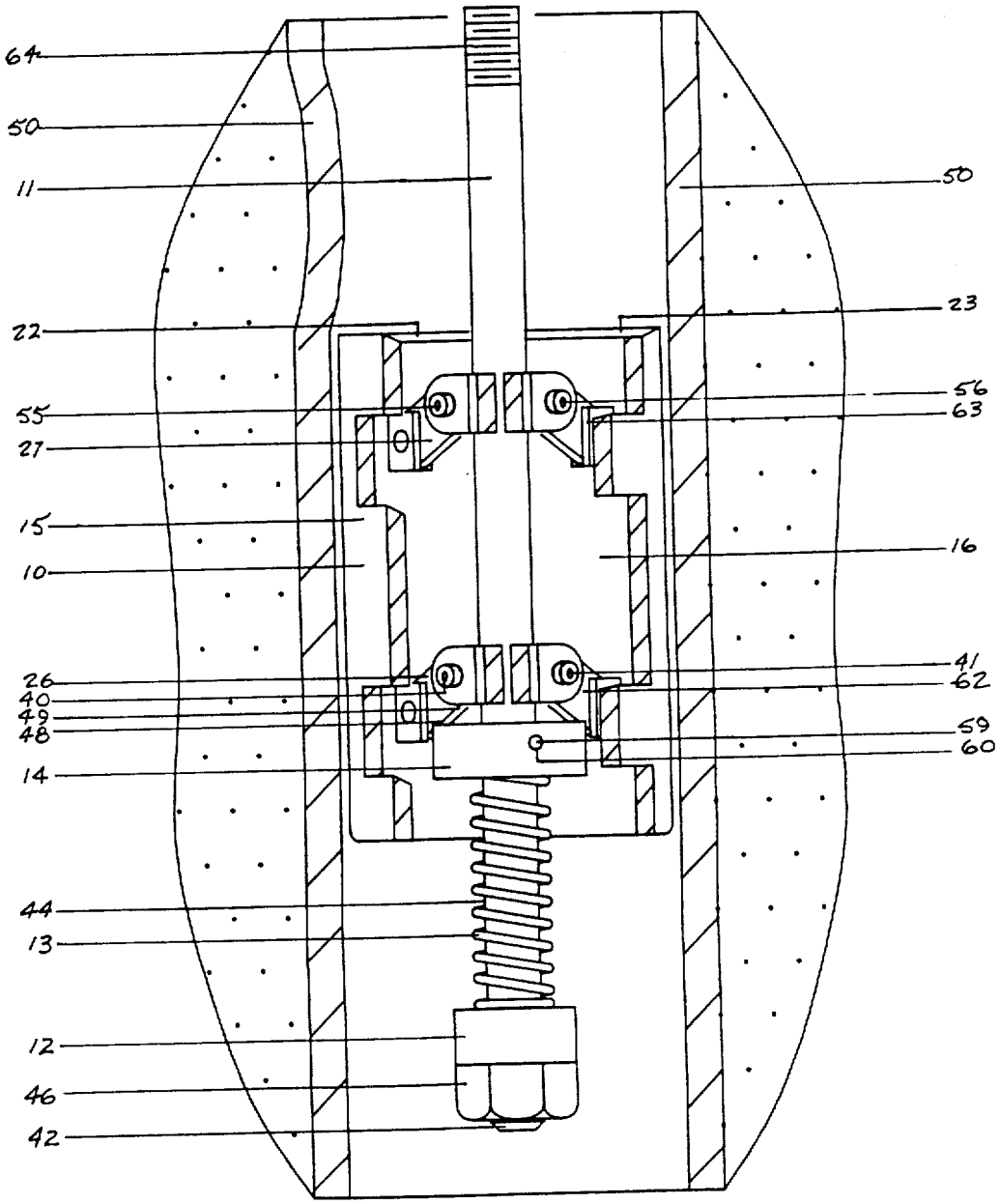
Figure 6:
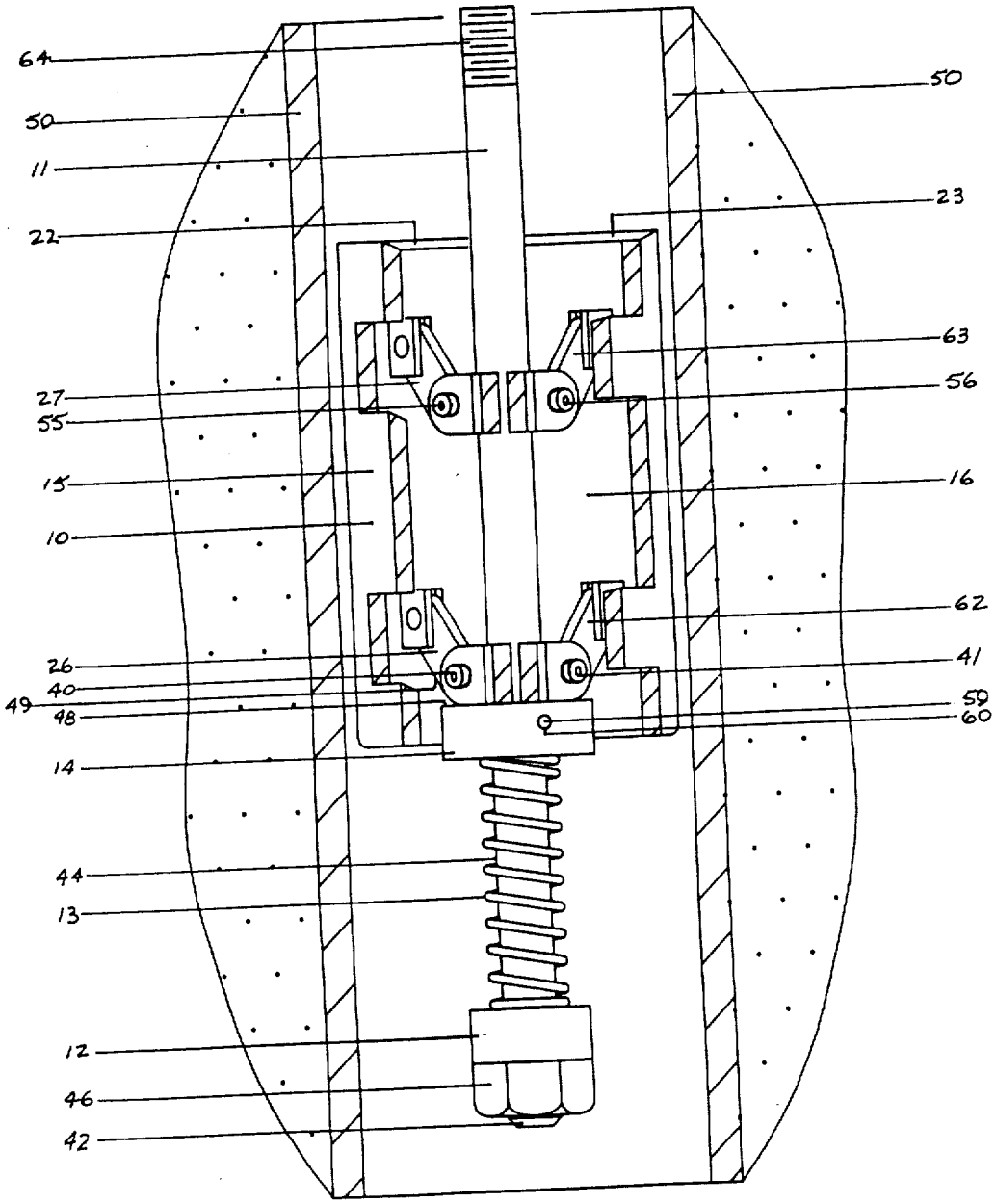

Referring now to FIGS. 4, 5, and 6 the operation of the casing scraper 10 may be observed.

FIG. 4 depicts the casing scraper of the present invention in its normal operating mode with the scraper blades 15 and 16 extended. Scraper blade 17 is not shown as this is a partial cutaway view. Connecting links 26, 27, 62, and 63 extend perpendicular to the axis of mandrel 11. As previously noted, scraper blades 15 and 16 extend to the maximum distance allowed by the length of the connecting mechanism from mandrel 11. Shear pin 59 is snugly contained within opening 60 of member 14 and extends into opening 61 (not shown) provided in mandrel 11. Spring 13 is compressed between support member 14 and support member 12. The tension on spring 13 may be adjusted by adjustment of the location of nut 46 on the threaded end 42 of mandrel 11. Upper threaded end 64 of mandrel 11 is connected to a cable system (not shown), which cable system extends to the surface of the oil or gas well. The casing scraper 10 may be raised or lowered in the well casing in such extended position, assuming that no obstructions are encountered.

Referring now to FIG. 6, the operation of the casing scraper 10 in its downward mode is depicted. Upon encountering an obstruction (obstruction not shown) while moving in a downward direction, the obstruction forces scraper blade 15 to move in an upward direction in relation to mandrel 11, thereby causing connecting link 26 to rotate about the axis defined by pin 40 and to rotate about the axis defined by pin 41. Likewise, connecting link 27 is inclined in an upward direction, connecting link 27 rotating about the axis defined by pin 55 and the axis defined by pin 56. In like manner, scraper blade 16 and scraper blade 17 (not shown) are forced in an upward direction with relation to the mandrel by such obstruction (not shown). The extent of the upward and inward movement of scraper blades 15, 16 and 17 with relation to mandrel 11 is limited by the abutment of the longitudinal edges of scraper blades 15, 16 and 17. Upon clearing such obstruction, the weight of scraper blades 15, 16 and 17 cause the scraper blades to extend to the normal position as depicted in FIG. 4.

Referring again to FIG. 4, the normal operating position of the casing scraper is shown. With the scraper blades extended, the cable is pulled towards the surface thereby pulling the casing scraper upward within the casing. Beveled edges 22, 23 and 24 (not shown) engage the material adhering to the inner surface of casing wall 50, dislodging the material from casing wall 50, and allowing the material to fall through the spaces within the casing scraper to the bottom of the casing. Referring to FIG. 1, extensions 20 and 21 of scraper blade 17, and like extensions provided on scraper blade 15 and scraper blade 16 provide a continuous cutting surface along the full circumference of the cylinder defined by scraper blades 15, 16 and 17. The interlocking longitudinal edges of scraper blade 15 and 17 prevent vertical movement of scraper blade 15 with relation to scraper blade 17. Likewise, vertical movement of scraper blade 16 with relation to scraper blades 15 and 17 is prevented by like interlocking longitudinal edges, thereby providing coordinated cutting by blades 15, 16 and 17.

Now referring to FIG. 5, the casing scraper 10 of the present invention is shown encountering an immoveable obstruction such as an indentation of casing wall 50. The immoveable obstruction forces scraper blade 15 in a downward direction with relation to mandrel 11, thereby shearing shear pin 59 and compressing spring 13. Upon clearing such immoveable obstruction, the expansive force of spring 13 exerts an upward force on member 14 thereby pushing connecting links 26 and 62 upward until connecting links 26 and 62 return to normal perpendicular orientation with relation to mandrel 1!, as depicted in FIG. 4. It is noted that shear pin 59 is not necessarY to maintain the normal perpendicular operating position of connecting links 26 and 62; its primary function is to indicate after the scraping operation whether an obstruction was encountered which had sufficient force to overcome the spring 13 and cause the shear pin to shear.

The foregoing disclosure and description of the casing scraper of the present invention are illustrative. Various embodiments of the foregoing concept may be practiced without departing from the scope and spirit of the invention.

I claim:

1. A pipe scraping device comprising:

a mandrel connected to means for moving the pipe scraping through the pipe;

a plurality of scraper blades or scraping material from the inside of the pipe;

each scraper being connected to the mandrel by at least one connecting link;

each connecting link being pivotally connected to each scraper blade and each connecting link being pivotally connected to the mandrel whereby:

when the connecting links are inclined upward in a first position, the plurality of scraper blades define a hollow cylinder surrounding the mandrel;

when the connecting links are inclined downward in a second position, the plurality of scraper blades define a hollow cylinder surrounding the mandrel;

when the connecting links are positioned perpendicular to the mandrel in a third position, the plurality of scraper blades are annularly expanded to define a hollow cylinder surrounding the mandrel with diameter larger than the diameter of the hollow cylinder defined in the first or second position, which third position is the normal position of the scraper blades during the scraping operation;

adjustable spring means for normally orienting the connecting links at a pre-determined angle in relation to the mandrel, which angle will normally be perpendicular to the mandrel, and which spring means resist downward inclination of the connecting links;

whereby the connecting links rotate upward in a first position when resistance is encountered during downward movement of the casing scraper;

whereby the connecting links are normally oriented perpendicular to the axis of the mandrel in a third position due to the force exerted by the spring means, the scraper blades thereby defining an annularly expanded hollow cylinder with diameter greater than the diameters of the hollow cylinders defined in the first and second position; and whereby the connecting links rotate downward in a second position when resistance is encountered in the upward scraping mode and the resistive force of the object encountered exceeds the upward force of the spring means.

2. The pipe scraping device of claim 1 wherein:

the spring means comprise:

a spring biased against a spring support member at one end of the spring and biased against a connecting link support member at the other end of the spring;

which spring support member is slideably retained on the lower end of the mandrel;

which connecting link support member is slideably retained on the mandrel engaging the spring at one of its ends and at least one of the connecting links at the other end.

3. The pipe scraping device of claim 2 wherein:

the force exerted by the spring may be adjusted by adjusting the location of the spring support member on the mandrel by means of a threaded nut engaging the underside of the spring support member with threads on the mandrel.

4. The pipe scraping device of claim 1 wherein:

each of the scraper blades is provided with extensions on the longitudinal side wall of the scraper blade, the adjoining scraper blade being provided with corresponding recesses in its longitudinal side wall whereby the extensions snugly fit within the recesses and comprise an interlocking surface, thereby providing effective scraping along the full circumference of the annularly expanded hollow cylinder and thereby providing structural stability to the hollow cylinder formed by the scraper blades.

5. The pipe scraping device of claim 1 wherein:

the plurality of scraper blades comprises three scraper blades, each scraper blade defining approximately 120 degrees of the arc of the hollow cylinder.

6. The pipe scraping device of claim 1 wherein:

there are two connecting links connecting each scraper blade to the mandrel.

7. The pipe scraping device of claim 2 wherein:

a shear pin is located in openings provided in the mandrel and in the connecting link support member which shear pin is sheared when the connecting links are inclined downward.

8. A pipe scraping device comprising:

a mandrel connected to means for moving the pipe scraping device through the pipe;

a plurality of scraper blades for scraping material from the inside of the pipe;

each scraper blade being connected to the mandrel by at least one connecting link;

each connecting link being pivotally connected to each scraper blade and each connecting link being pivotally connected to the mandrel whereby:

when the connecting links are inclined upward in a first position, the plurality of scraper blades define a hollow cylinder surrounding the mandrel;

when the connecting links are inclined downward in a second position, the plurality of scraper blades define a hollow cylinder surrounding the mandrel;

when the connecting links are positioned perpendicular to the mandrel in a third position, the plurality of scraper blades are annularly expanded to define a hollow cylinder surrounding the mandrel with diameter larger than the diameter of the hollow cylinder defined in the first or second position, which third position is the normal position of the scraper blades during the scraping operation;

adjustable spring means for normally orienting the connecting links at a pre-determined angle in relation to the mandrel, which angle will normally be perpendicular to the mandrel, and which spring means resist downward inclination of the connecting links;

whereby the connecting links rotate upward in a first position when resistance is encountered during downward movement of the casing scraper;

whereby the connecting links are normally oriented perpendicular to the axis of the mandrel in a third position due to the force exerted by the spring means, the scraper blades thereby defining an annularly expanded hollow cylinder with diameter greater than the diameters of the hollow cylinders defined in the first and second position, and whereby the connecting links rotate downward in a second position when resistance is encountered in the upward scraping mode when the resistive force of the object encountered exceeds the upward force of the spring means;

wherein the spring means comprise:

a spring biased against a spring support member at one end of the spring and biased against a connecting link support member at the other end of the spring;

which spring support member is slideably retained on the lower end of the mandrel;

which connecting link support member is slideably retained on the mandrel engaging the spring at one of its ends and at least one of the connecting links at the other end;

wherein the force exerted by the spring may be adjusted by adjusting the location of the spring support member on the mandrel by means of a threaded nut engaging the underside of the spring support member and threads on the mandrel;

wherein each of the scraper blades is provided with extensions of the longitudinal side wall of the scraper blade, the adjoining scraper blade being provided with corresponding recesses in its longitudinal side wall whereby the extensions snugly fit within the recesses and comprise an interlocking surface, thereby providing effective scraping along the full circumference of the annularly expanded hollow cylinder and thereby providing structural stability to the hollow cylinder formed by the scraper blades.

9. The pipe scraping device of claim 8 wherein:

the plurality of scraper blades comprises three scraper blades, each scraper blade defining approximately 120 degrees of the arc of the hollow cylinder.

10. The pipe scraping device of claim 8 wherein:

there are two connecting links connecting each scraper blade to the mandrel.

11. The pipe scraping device of claim 8 wherein:

a shear pin is located in openings provided in the mandrel and in the connecting link support member which shear pin is sheared when the connecting links are inclined downward.

* * * * *

UNITED STATES PATENT AND TRADEMARK OFFICE

CERTIFICATE OF CORRECTION

PATENT NO. : 5,000,260

DATED : Mar. 19, 1991

INVENTOR(S) : Martin J. Fontenot

It is certified that error appears in the above-identified patent and that said Letters Patent is hereby corrected as shown below:

The title page, showing the illustrative figure, should be deleted and substitute therefor the attached title page.

FIGS. 1-6 (Drawing Sheets 1-6) should be deleted to be replaced with the attached FIGS. 1-6.

Signed and Sealed this

Twentieth Day of July, 1993

*Attest:*

Michael K. Kirk

MICHAEL K. KIRK

*Attesting Officer*

*Acting Commissioner of Patents and Trademarks*

United States Patent [19]

Fontenot

[11] Patent Number: 5,000,260

[45] Date of Patent: Mar. 19, 1991

[54] CASING SCRAPER

[75] Inventor: Martin J. Fontenot, Silsbee, Tex.

[73] Assignee: New World Down Hole Tools, Incorporated, Pasadena, Tex.

[21] Appl. No.: 461,976

[22] Filed: Jan. 8, 1990

[51] Int. Cl.[5] ..... E21B 37/02

[52] U.S. Cl. ..... 166/173; 15/104.16; 15/104.17; 166/174; 166/175

[58] Field of Search ..... 166/173, 174, 175, 176; 15/104.16, 104.17

[56] References Cited

U.S. PATENT DOCUMENTS

| | | | |
|---|---|---|---|
| 560,830 | 5/1896 | Balz | 15/104.17 X |
| 784,359 | 3/1905 | Stephenson | 15/104.16 |
| 1,165,441 | 12/1915 | Packingham | 15/104.16 |
| 1,666,000 | 4/1928 | Campbell | 166/174 |
| 2,141,508 | 12/1938 | Buckley et al. | 166/174 |
| 2,221,137 | 11/1940 | Hector | 166/174 |
| 2,464,390 | 3/1949 | Hammer | 166/173 |
| 4,189,000 | 2/1980 | Best | 166/173 |
| 4,706,748 | 11/1987 | Harris | 166/173 |

*Primary Examiner*—Hoang C. Dang
*Attorney, Agent, or Firm*—Keeling & Associates

[57] ABSTRACT

A casing scraper is provided for scraping foreign materials from the inside of pipe casing and other tubular members. The casing scraper is comprised of a central mandrel supporting a plurality of longitudinally and circumferentially extending scraper blades, the collective configuration of the scraper blades comprising a tube structure with the mandrel located at the longitudinal axis of the tube structure. Connecting links attach the mandrel to the plurality of scraper blades. Said connecting links are each pivotally attached to the mandrel and to the scraper blades. An adjustable spring is provided at the base of the mandrel and biased against the underside of the connecting links normally biasing said connecting links at a right angle to the axis of the mandrel, thereby normally positioning the scraper blades at the maximum distance from the mandrel allowed by the length of the connecting links. Upon assertion on the scraper blades of upward pressure or upon assertion on the scraper blades of downward pressure exceeding the spring force, the connecting links may extend at an angle other than ninety degrees from the mandrel, thereby allowing the scraper blades to retract inwardly toward the mandrel. The inward movement of the casing scraper blades is limited by the abutment of the longitudinal edges of the scraper blades. Interlocking extending sections and recesses are provided along the longitudinal edges of the scraper blades to provide continuity of the cutting surface.

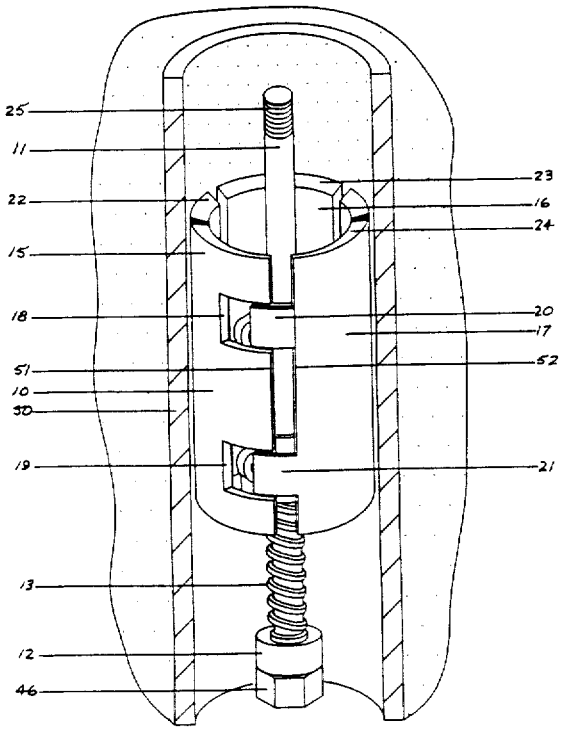

11 Claims, 6 Drawing Sheets